US006067427A

United States Patent [19]

Shin

[11] Patent Number: 6,067,427

[45] Date of Patent: May 23, 2000

[54] APPARATUS AND A METHOD FOR REMOVING REMAINING TONER FROM AN IMAGE FORMING APPARATUS

[75] Inventor: Sang-Yob Shin, Kyonggi-do, Rep. of Korea

[73] Assignee: SamSung Electronics Co., Ltd., Suwon, Rep. of Korea

[21] Appl. No.: 09/216,954

[22] Filed: Dec. 21, 1998

[30] Foreign Application Priority Data

Dec. 20, 1997 [KR] Rep. of Korea ..... 97-71383

[51] Int. Cl.[7] ..... G03G 15/08

[52] U.S. Cl. ..... 399/53; 399/281; 399/283

[58] Field of Search ..... 399/53, 55, 38, 399/272, 273, 281, 283, 285

[56] References Cited

U.S. PATENT DOCUMENTS 4,873,940 10/1989 Ishikawa et al. ..... 399/143
4,947,212 8/1990 Ikegawa et al. ..... 399/55 X
5,324,884 6/1994 Honda et al. ..... 399/279
5,473,417 12/1995 Hirano ..... 399/285
5,826,138 10/1998 Tsuru et al. ..... 399/55

*Primary Examiner*—Richard Moses
*Attorney, Agent, or Firm*—Robert E. Bushnell, Esq.

[57] ABSTRACT

A method and apparatus for removing remaining toner from an image forming apparatus, when a non developing time is detected during a performing of printing, a supply voltage applied to a supplying roller is increased to a level higher than a developing voltage applied to a developing roller. When the supplying roller having the supplying voltage of a voltage level higher than the developing voltage is in contact with the developing roller, electric flux is directed from the supplying voltage having a high electric potential to the developing voltage having a low electric potential due to a difference of intensities of electric fields between the supplying roller and the developing roller, while toner having negative charge moves from the developing roller to the supplying roller in a reverse direction to that of the direction of the electric flux to remove the remaining toner.

22 Claims, 5 Drawing Sheets

APPARATUS AND A METHOD FOR REMOVING REMAINING TONER FROM AN IMAGE FORMING APPARATUS

CLAIM OF PRIORITY

This application makes reference to, incorporates the same herein, and claims all benefits accruing under 35 U.S.C. §119 from an application for *AN APPARATUS AND A METHOD FOR REMOVING REMAINING TONER FROM AN IMAGE FORMING APPARATUS* earlier filed in the Korean Industrial Property Office on Dec. 20, 1997 and there duly assigned Serial No. 71383/1997.

BACKGROUND OF THE INVENTION

1. Field of the Invention

The present invention relates to an apparatus and a method for removing remaining toner from an image forming apparatus, and more particularly to an apparatus and a method for removing remaining toner from an image forming apparatus, in which an electric power which is supplied to a supplying roller is interrupted by a controller for controlling a supply of the electric power for a time that forming an image is not performed, thereby removing the remaining toner from a developing roller.

2. Description of the Related Art

Generally, an image forming apparatus to which an electrophotography developing technique is adapted, such as a copier and a printer, includes a pickup roller, an electrification roller, a photosensitive drum, a transferring roller, a developing roller, a supplying roller, a fixing device, and an exposure device.

The electrification roller which is electrified with an electrification voltage electrifies a photosensitive film formed on a peripheral surface of the photosensitive drum while rotating. Then, a light emitted from the exposure device makes an electrostatic latent image to be formed on the surface of the photosensitive drum. There is a difference of electric potential between the supplying roller to which a supplying voltage is applied and the developing roller to which a higher level voltage than the supplying voltage is applied. As a result, negative electric charges move from the supplying roller to the developing roller. The toner supplied to the developing roller covers the electrostatic latent image formed on the surface of the photosensitive drum so as to form the realistic image. The transferring roller having the high voltage transfers the realistic image formed in a manner that the toner that covers the surface of the photosensitive drum is transferred to the recordable paper carried by guide rollers. The realistic image transferred to the recordable paper is fixed on the recordable paper under a high temperature and a high pressure by the fixing device. The printing is therefore completed.

The supplying voltage, the developing voltage, the transferring voltage, and the electrification voltage are respectively and continuously supplied to the supplying roller, the developing roller, the transferring roller, and the electrification roller unless the printing is ended.

However, if the printing is continuously performed as described above, the toner which is not supplied to the photosensitive drum remains on the developing roller. The remaining toner must be returned to the supplying roller or removed by a cleaning device. If the printing is continuously performed in a state that the remaining toner is not removed, a problem arises in that the quality of the printing is degraded.

In the case as described above, a user visually identifies the printing status on the recordable paper. When the user determines that the recordable paper is polluted, the user separates the image forming apparatus into a plurality of parts and removes the toner remaining on the developing roller. Accordingly, it is difficult for the user to separate the image forming apparatus into the plural parts and assemble them with each other.

Furthermore, since the user must identify the pollution of the recordable paper, the recordable paper is wasted as much as the recordable paper is polluted.

SUMMARY OF THE INVENTION

The present invention has been made to overcome the above described problems exemplary of contemporary practice in the art.

It is an object of the present invention to provide a method for removing remaining toner from an image forming apparatus, in which toner remaining on a developing roller during a printing is returned by a supplying roller to a toner cartridge, resulting in preventing the image forming apparatus from being polluted by the toner.

It is another object of the present invention to provide an apparatus for removing remaining toner from an image forming apparatus according to the above method of the present invention.

To accomplish the above and other objects of the present invention, there is provided a method for removing remaining toner from an image forming apparatus in which toner is supplied from a toner cartridge to a photosensitive drum by a supplying roller and a developing roller by using an electric potential difference between a supplying voltage having a first level and a developing voltage having a second level higher than the supplying voltage, comprising the steps of: checking a starting point of a non developing time for which no printing is performed; increasing the supplying voltage to a higher level than the developing voltage having the second level when the starting point of the non developing time is checked; and dropping the supplying voltage to the first level after a predetermined time passes from the starting point of the non developing time.

Preferably, the non developing time is a time from a finishing point at which the printing of a page of data is completed to a starting point which the next printing of a page of data is started.

The predetermined time is equal to or smaller than the non developing time. In the step for increasing the supplying voltage, it is desirable the supplying voltage applied to the supplying roller is interrupted for the predetermined time.

According to another aspect of the present invention, there is provided an apparatus for removing remaining toner from an image forming apparatus in which a photosensitive drum is charged with electricity at a surface thereof by an electrifying roller, an exposure device for forming a latent image on the surface of the photosensitive drum, toner which is supplied by a supplying roller and a developing roller and attached to the latent image forms a visible image, and a transferring roller for making the image attach on a paper, comprising: a controller for controlling a supplying voltage applied to the supplying roller; and a central processing unit (CPU) for detecting a starting point of a non developing time for which a printing is not performed and for controlling the supplying voltage supplied to the supplying roller for a predetermined time from the starting point of the non developing time to increase the supplying voltage to an electric potential level higher than a developing voltage applied to the developing roller.

The non developing time is a time from a finishing point at which the printing of a page of data is completed to a starting point at which the next printing of a page of data is started.

Preferably, the predetermined time is equal to or smaller than the non developing time.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Hereinafter, an apparatus and a method for removing remaining toner from an image forming apparatus according to embodiments of the present invention will be described in detail with reference to accompanying drawings.

Figure 1:
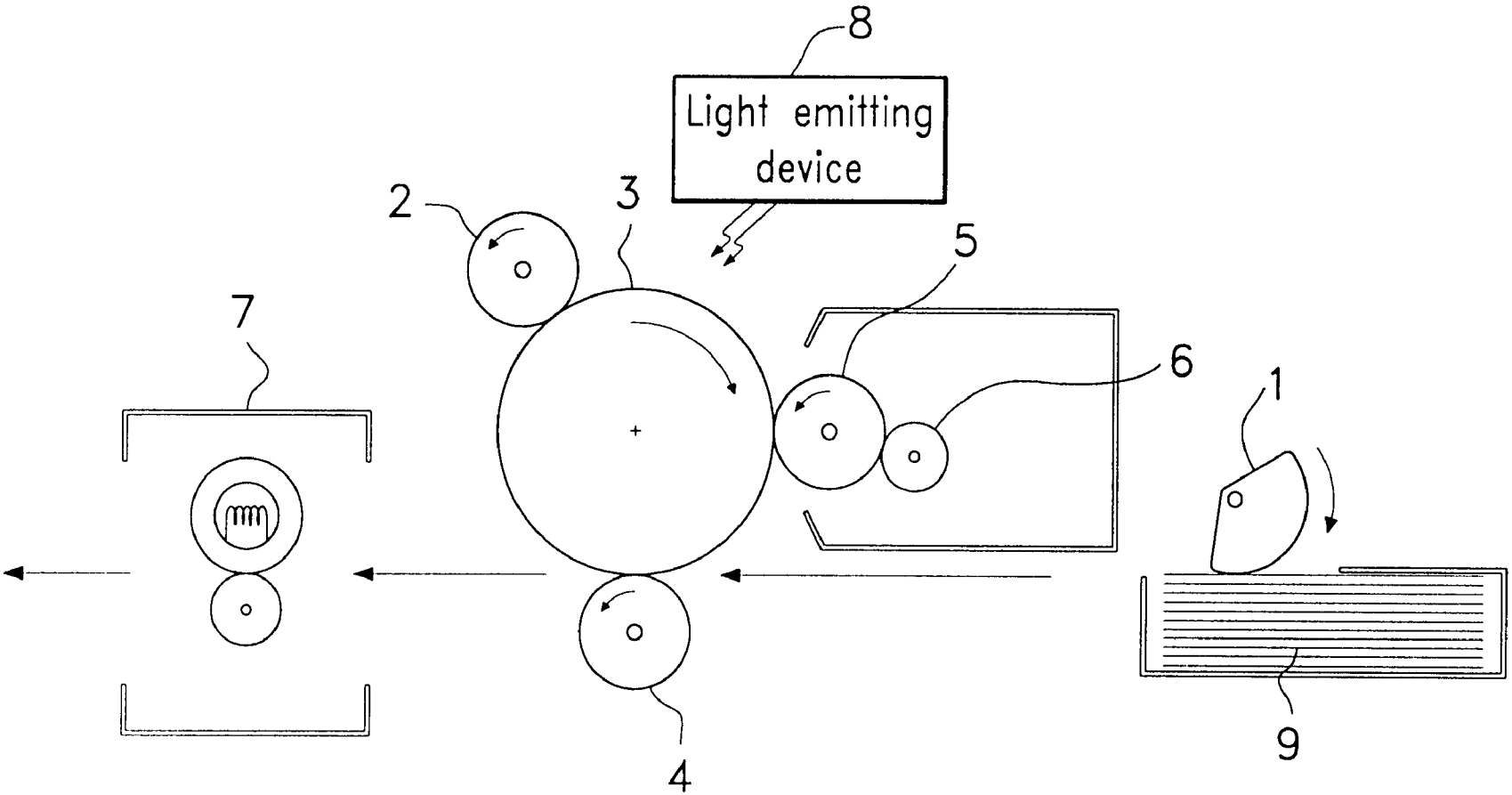
FIG. 1 is a schematic view of a construction of an image forming apparatus exemplary of contemporary practice in the art.

Referring to FIG. 1, generally an image forming apparatus to which an electrophotography developing technique is adapted, such as a copier and a printer, includes a pickup roller 1, an electrification roller 2, a photosensitive drum 3, a transferring roller 4, a developing roller 5, a supplying roller 6, a fixing device 7, and an exposure device 8.

The electrification roller 2 which is electrified with an electrification voltage electrifies a photosensitive film formed on a peripheral surface of the photosensitive drum 3 while rotating. Then, a light emitted from the exposure device 8 makes an electrostatic latent image to be formed on the surface of the photosensitive drum 3. There is a difference of electric potential between the supplying roller 6 to which a supplying voltage is applied and the developing roller 5 to which a higher level voltage than the supplying voltage is applied. As a result, negative electric charges move from the supplying roller 6 to the developing roller 5. The toner supplied to the developing roller 5 covers the electrostatic latent image formed on the surface of the photosensitive drum 3 so as to form the realistic image. The transferring roller 4 having the high voltage transfers the realistic image formed in a manner that the toner that covers the surface of the photosensitive drum 3 is transferred to the recordable paper 9 carried by guide rollers. The realistic image transferred to the recordable paper 9 is fixed on the recordable paper 9 under a high temperature and a high pressure by the fixing device 7. The printing is therefore completed.

The supplying voltage, the developing voltage, the transferring voltage, and the electrification voltage are respectively and continuously supplied to the supplying roller 6, the developing roller 5, the transferring roller 4, and the electrification roller 2 unless the printing is ended.

However, if the printing is continuously performed as described above, the toner which is not supplied to the photosensitive drum 3 remains on the developing roller 5. The remaining toner must be returned to the supplying roller 6 or removed by a cleaning device.

Figure 2:
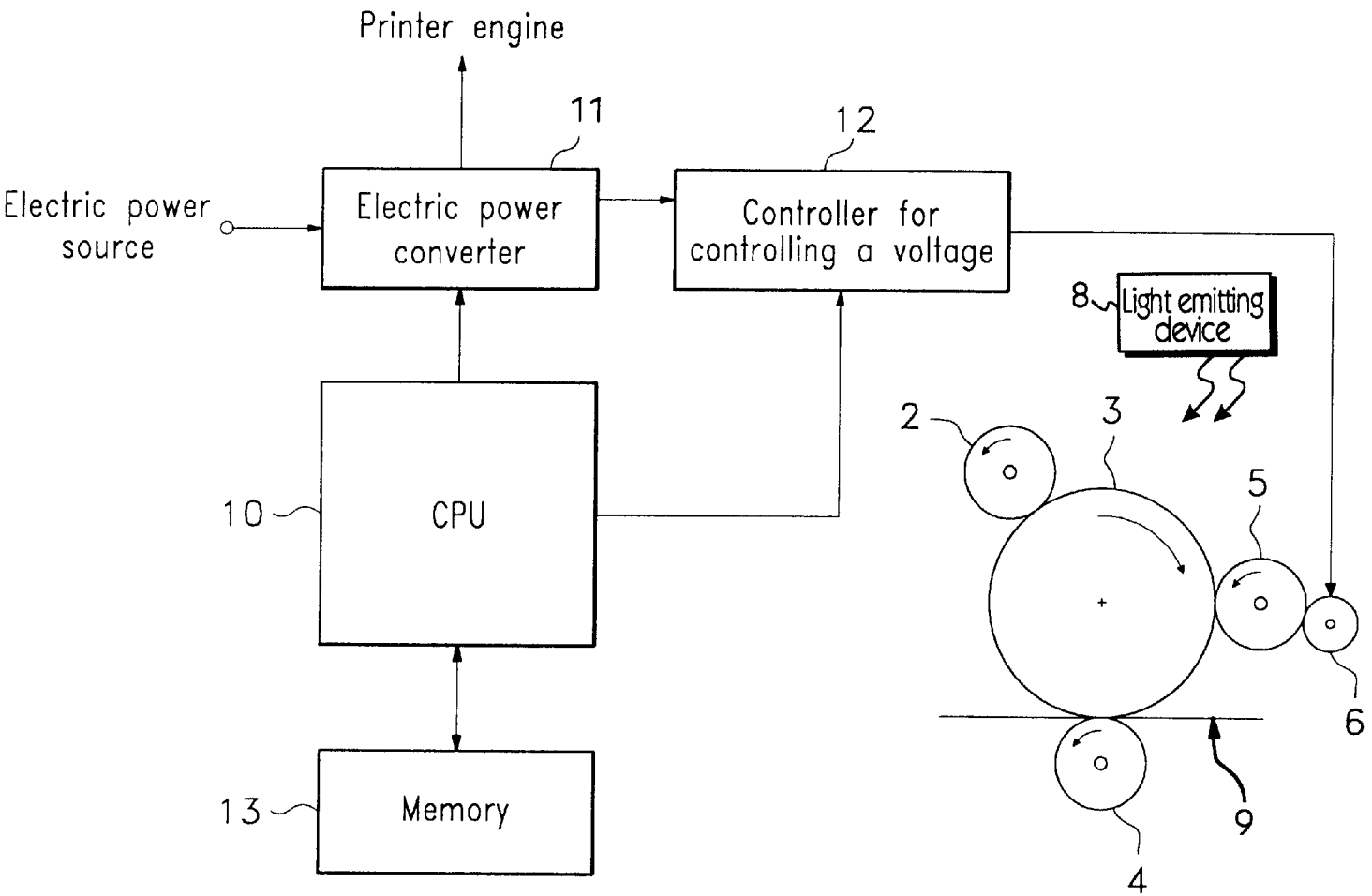
FIG. 2 is a partial view of an apparatus for removing remaining toner from an image forming apparatus according to the present invention.
Figure 3:
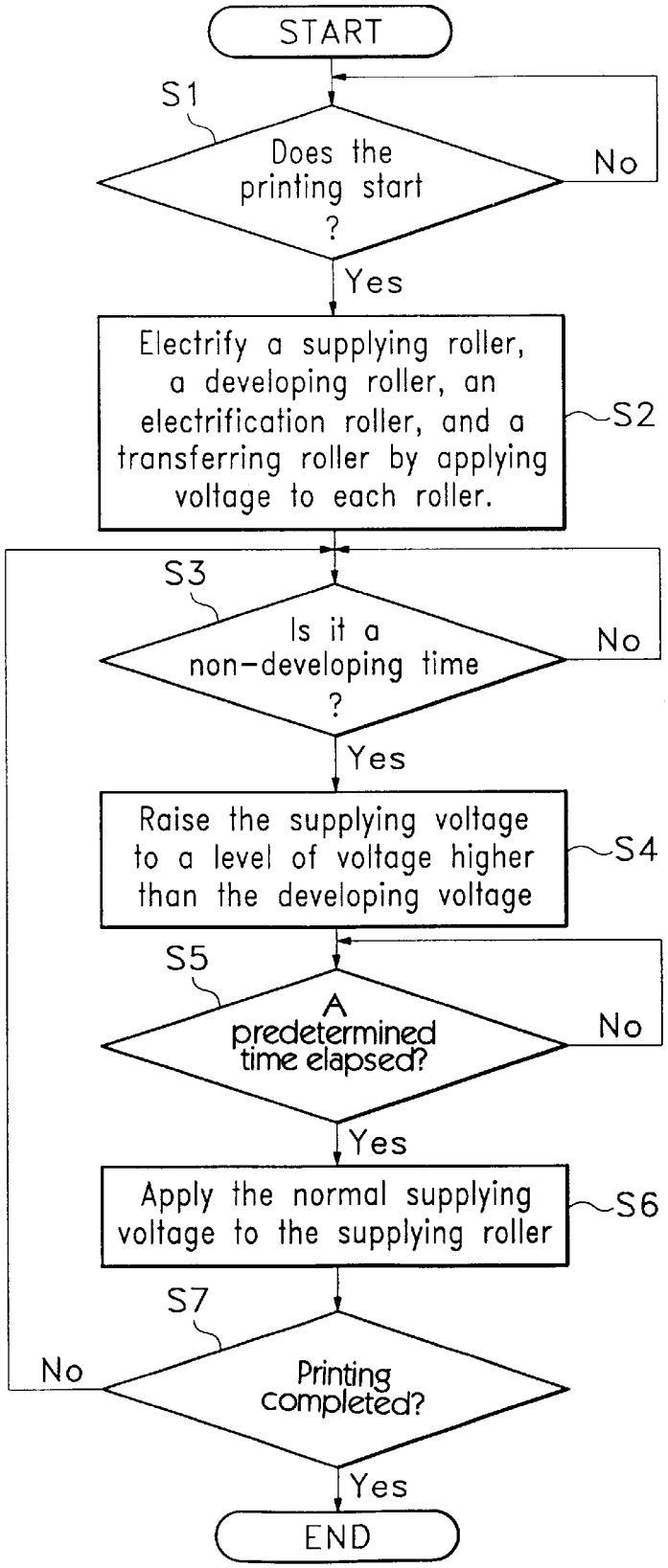
FIG. 3 is a flow chart showing a process of removing the remaining toner from the image forming apparatus according to the present invention.
Figures 4A, 4B, 4C, 4D:
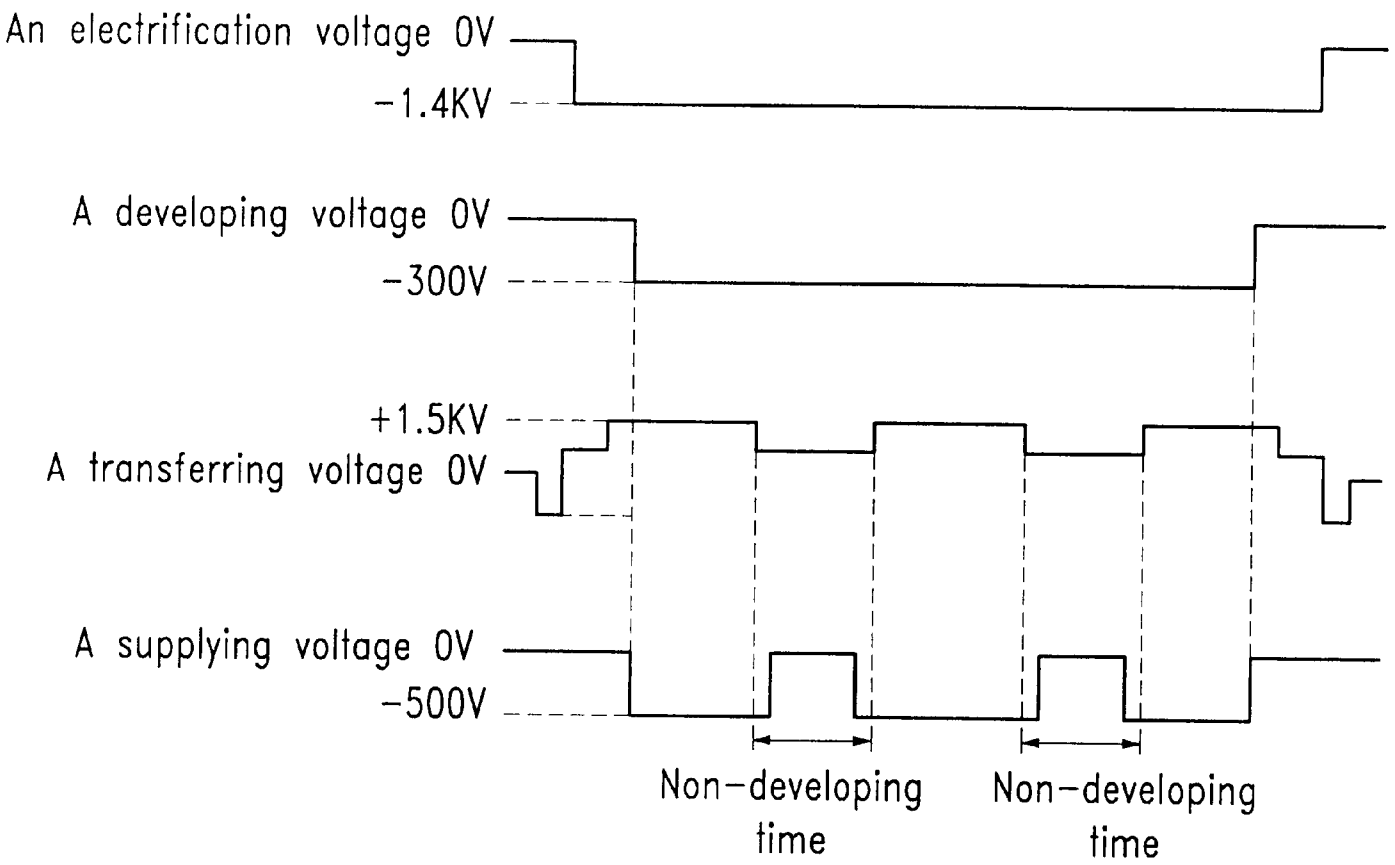
FIG. 4 is a view showing waves of voltages supplied to various elements in the image forming apparatus in FIG. 2 in the present invention.

FIG. 2 is a partial view of an apparatus for removing remaining toner from an image forming apparatus according to of the present invention. In FIG. 2, like numerals denote the same elements as that in FIG. 1.

As shown in FIG. 2, a central processing unit (CPU) 10 controls the elements in the image forming apparatus according to a desired program.

An electric power converter 11 to which a common voltage (110V or 220V) is applied increases the common voltage to a level of a voltage required to a printer engine and then applies the level of the voltage to the printer engine according to a control of the CPU 10.

A supplying voltage controller 12 controls a level of a voltage applied to a supplying roller 6 according to the control of the CPU 10.

A memory 13 has various program stored therein in order that the CPU 10 controls the image forming apparatus and receives image data to be printed using the printer engine.

Hereinafter, an operation of the image forming apparatus according to the present invention will be described with reference to FIGS. 2 to 5.

When an order for printing of the image data is received in the CPU 10 at step S1, the CPU 10 controls the electric power converter 11 to output a voltage which each element of the printer engine requires. In the image forming apparatus, an electrification voltage applied to an electrification roller 2 is about a level of −1.4 kV, a developing voltage applied to a developing roller 5 is about a level of −300 V, a transferring voltage applied to a transferring roller 4 is about a level of +1.5 kV, and the supplying voltage applied to a supplying roller 6 is about a level of −500 V (see FIGS. 4A to 4D).

Therefore, the electric power converter 11 converts the common voltage into the electrification voltage (−1.4 kV), the developing voltage (−300 V), the transferring voltage (+1.5 kV at a maximum), and the supplying voltage (−500 kV) and electrifies the electrification roller 2, the developing roller 5, the transferring roller 4, and the supplying roller 6 in sequence of a set respectively, at step S2.

Therefore, the electrification roller 2 electrifies a surface of a photosensitive drum 3 at a predetermined level of an electric potential and an exposure device 8 converts data to be printed into a light signal. Then, the light signal is emitted on the photosensitive drum 3 to form an electrostatic latent image on the surface of the photosensitive drum 3.

Further, as the supplying roller 6 is electrified, toner covers a surface of the supplying roller 6. Then, the toner covering the supplying roller 6 is transferred to a surface of the developing roller 5 due to a difference of the electric potential between the supplying roller 6 and the developing roller 5. That is, when there is the difference of the electric potential between the supplying roller 6 and the developing roller 5, the toner having negative charges is transferred from the supplying roller 6 having a lower level of the voltage to the developing roller 5 having a higher level of the voltage.

On the other hand, the photosensitive drum 3 is electrified at about −800 V of the electric potential by the electrification voltage of −1.4 kV supplied from the electrification roller 2. The electrostatic latent image has an electric potential of 0 V due to the light emitted from the exposure device 8.

Moreover, since the developing roller 5 is electrified at a −300 V level of the electric potential, the electrostatic latent image is covered with the toner covering the surface of the developing roller 5 according to the electric flux and an amount of the toner, as described above. As a result, the image is formed corresponding to the electrostatic latent image by the toner.

In principle, as mentioned above, the image formed on the photosensitive drum 3 is transferred by the transferring roller 4 by a high voltage of the transferring roller 4. At this time, the recordable paper 9 is carried between the photosensitive drum 3 and the transferring roller 4 while the image is transferred to the recordable paper 9.

After the toner is transferred to the recordable paper 9, the toner is attached to the recordable paper 9 under a high temperature and a high voltage by a fixing device 7 (FIG. 1). The printing of a page of the image data is therefore accomplished.

The printing can not be performed from a finishing point at which the printing of a page of the image data is completed to a starting point at which the printing of next page of the image data is started. At that time, the voltage applied to the transferring roller 4 is reduced to a lower level than +1.5 kV.

The CPU 10 detects a time for which the voltage applied to the transferring roller 4 is reduced, e.g. a non-developing time, at step S3. Then, the CPU 10 controls the controller 12 for adjusting the supplying voltage to increase the supplying voltage higher than the developing voltage at step S4 (see FIG. 4D).

Increasing the supplying voltage to higher level than the developing voltage is achieved by interrupting the supplying voltage (−500 V) for a while so as to supply a ground electric potential (0V) and by supplying higher voltage than the ground electric potential. Therefore, the supplying voltage has a level of the electric potential higher than the developing voltage and the toner remaining on the developing roller 5 is therefore moved to the supplying roller 6. As a result, the toner remaining on the developing roller 5 can be removed.

Figure 5:
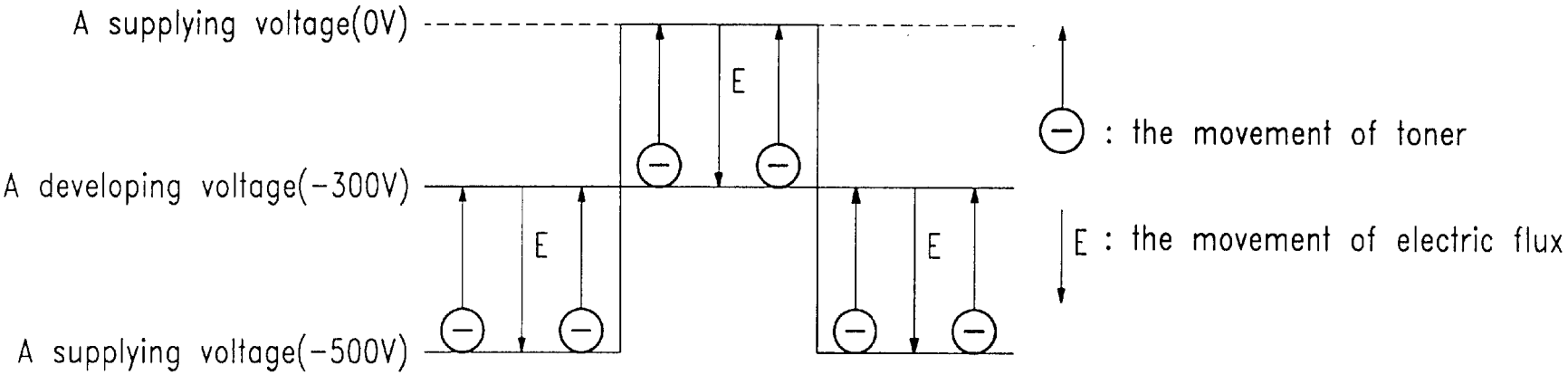
FIG. 5 is a view of illustrating returning the toner remaining on a developing roller to a toner cartridge by using a supplying roller in the present invention.

Referring to FIG. 5, when the supplying roller 6 having the supplying voltage of a voltage level higher than the developing voltage is in contact with the developing roller 5, electric flux is directed from the supplying voltage having a high electric potential to the developing voltage having a low electric potential due to a difference of intensities of electric fields between the supplying roller 6 and the developing roller 5, while toner having a negative charge moves from the developing roller 5 to the supplying roller 6 in a reverse direction to that of the direction of the electric flux to remove the remaining toner.

On the other hand, the CPU 10 checks whether a predetermined time has passed or elapsed, at step S5. When the CPU 10 determines that the predetermined time has passed or elapsed, the CPU 10 controls the controller 12 for adjusting the supplying voltage so as to apply the lower level supplying voltage (−500 V) to the supplying roller 6 at step S6. Accordingly, the developing roller 5 has a higher voltage level (−300V) than the supplying roller 6 enough to perform the printing of a page of data.

At step S7, the CPU 10 checks whether the printing is completed. When the printing is not completed, the CPU 10 returns to step S3 and performs the steps S3 through S7 again. When the printing is completed the CPU 10 finishes its operations and the process ends.

As described above, the time for which the supplying voltage has a higher level than the developing voltage is set to be equal to or smaller than the non-developing time.

In the apparatus and the method for removing the toner remaining in the image forming apparatus according to the present invention, there is an advantage in that the quality of the printing can be improved by raising the supplying voltage applied to the supplying roller for the non-developing time to be higher than the developing voltage so that the toner remaining on the developing roller can be removed.

Furthermore, there is another advantage of the present invention in that the recordable paper can be prevented from being polluted by removing the toner remaining on the developing roller, thereby preventing the recordable paper from being wasted.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modification may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A method for removing remaining toner from an image forming apparatus, comprising the steps of:

supplying toner to a photosensitive drum by a supplying roller and by a developing roller using an electric potential difference between a supplying voltage for the supplying roller having a first voltage level and a developing voltage for the developing roller having a second voltage level higher than the first voltage level for the supplying voltage, determining a starting point of a non developing time during which no printing is performed;

increasing the supplying voltage for the supplying roller from the first voltage level to a third voltage level higher than the second voltage level for the developing voltage for the developing roller during at least a part of the non developing time; and returning the supplying voltage for the supplying roller to the first voltage level after a predetermined time passes from the starting point of the non developing time.

2. The method for removing remaining toner from an image forming apparatus as claimed in claim 1, wherein the non developing time is a time from a finishing point at which a printing of a page of data is completed to a starting point at which a next printing of a page of data is started.

3. The method for removing remaining toner from an image forming apparatus as claimed in claim 2, wherein the predetermined time is one of equal to and smaller than the non developing time.

4. The method for removing remaining toner from an image forming apparatus as claimed in claim 3, wherein the first voltage level is −500 volts, the second voltage level is −300 volts and the third voltage level is at least 0 volts.

5. The method for removing remaining toner from an image forming apparatus as claimed in claim 1, wherein in the step of increasing the supplying voltage, the supplying voltage of the first voltage level applied to the supplying roller is interrupted for the predetermined time.

6. The method for removing remaining toner from an image forming apparatus as claimed in claim 5, wherein the first voltage level is −500 volts, the second voltage level is −300 volts, and the third voltage level is at least 0 volts.

7. The method for removing remaining toner from an image forming apparatus as claimed in claim 1, wherein the first voltage level is −500 volts, the second voltage level is −300 volts, and the third voltage level is at least 0 volts.

8. A method for removing the remaining toner from an image forming apparatus, comprising the steps of:

determining a starting point of a non-developing time for which no printing is performed; and increasing the supplying voltage for a supplying roller used for supplying toner from a first voltage level to a voltage level higher than a second voltage level for a developing roller used for supplying toner during at least part of the non-developing time during which no printing is performed.

9. The method for removing remaining toner from an image forming apparatus as claimed in claim 8, wherein the non-developing time is a time from a finishing point at which a printing of a page of data is complete to a starting point at which a next printing of a page of data is started.

10. The method for removing remaining toner from an image forming apparatus as claimed in claim 9, wherein the first voltage level is −500 volts, the second voltage level is −300 volts, and the voltage level higher than the second voltage level is at least 0 volts.

11. The method for removing remaining toner from an image forming apparatus as claimed in claim 8, wherein the first voltage level is −500 volts, the second voltage level is −300 volts, and the voltage level higher than the second voltage level is at least 0 volts.

12. An apparatus for removing remaining toner from an image forming apparatus, comprising:

a photosensitive drum;

an electrifying roller for electrically charging the photosensitive drum at a surface of the photosensitive drum;

an exposure device for forming a latent image on the surface of the photosensitive drum;

a supplying roller and a developing roller for supplying toner to form a visible image from the latent image;

a transferring roller for forming the visible image on a paper;

a controller for controlling a supplying voltage applied to the supplying roller; and a central processing unit (CPU) for detecting a starting point of a non developing time during which printing is not performed and for controlling the supplying voltage for the supplying roller for a predetermined time during the non developing time to increase the supplying voltage to an electric potential level higher than a developing voltage applied to the developing roller.

13. The apparatus for removing remaining toner from an image forming apparatus as claimed in claim 12, wherein the non developing time is a time from a finishing point at which a printing of a page of data is completed to a starting point at which a next printing of a page of data is started.

14. The apparatus for removing remaining toner from an image forming apparatus as claimed in claim 13, wherein the predetermined time is one of equal to and smaller than the non developing time.

15. The apparatus for removing remaining toner from an image forming apparatus as claimed in claim 14, wherein the supplying voltage for the supplying roller is increased from −500 volts to at least 0 volts during the predetermined time, and the developing voltage applied to the developing roller is −300 volts.

16. The apparatus for removing remaining toner from an image forming apparatus as claimed in claim 12, wherein the supplying voltage for the supplying roller is increased from −500 volts to at least 0 volts during the predetermined time, and the developing voltage applied to the developing roller is −300 volts.

17. The apparatus for removing remaining toner from an image forming apparatus as claimed in claim 12, wherein the predetermined time is one of equal to and smaller than the non-developing time.

18. An apparatus for removing remaining toner from an image forming apparatus, comprising:

a controller for controlling a supplying voltage applied to a supplying roller used for supplying toner; and a central processing unit (CPU) for detecting a starting point of a non-developing time during which printing is not performed and for controlling the supplying voltage for the supplying roller for a predetermined time during the non-developing time to increase the supplying voltage to an electric potential level higher than a developing voltage applied to a developing roller also used for supplying toner.

19. The apparatus for removing remaining toner for an image forming apparatus as claimed in claim 18, wherein the non-developing time is a time from a finishing point at which a printing of a page of data is completed to a starting point at which a next printing of a page of data is started.

20. The apparatus for removing remaining toner for an image forming apparatus as claimed in claim 19, wherein the predetermined time is one of equal to and smaller than the non-developing time.

21. The apparatus for removing remaining toner for an image forming apparatus as claimed in claim 20, wherein the supplying voltage for the supplying roller is increased from −500 volts to at least 0 volts during the predetermined time, and the developing voltage applied to the developing roller is −300 volts.

22. The image forming apparatus as claimed in claim 18, wherein the supplying voltage for the supplying roller is increased from −500 volts to at least 0 volts during the predetermined time, and the developing voltage applied to the developing roller is −300 volts.

* * * * *